US005382104A

United States Patent [19]

Hirono et al.

[11] Patent Number: 5,382,104

[45] Date of Patent: Jan. 17, 1995

[54] PRINTING APPARATUS

[75] Inventors: Tetsuro Hirono; Mikio Shinada, both of Kamakura, Japan

[73] Assignee: Mitsubishi Denki Kabushiki Kaisha, Tokyo, Japan

[21] Appl. No.: 153,877

[22] Filed: Nov. 17, 1993

[30] Foreign Application Priority Data

Nov. 11, 1991 [JP] Japan ..... 3-294152

[51] Int. Cl.[6] ..... B41J 11/50

[52] U.S. Cl. ..... 400/608.2; 400/596; 400/605; 400/600.3

[58] Field of Search ..... 400/55, 56, 554, 568, 400/605-608.4, 648, 649, 703, 709, 596, 600.3; 271/9, 111

[56] References Cited

U.S. PATENT DOCUMENTS

| | | | |
|---|---|---|---|
| 4,615,630 | 10/1986 | Maeshima | 400/608.3 |
| 5,026,183 | 6/1991 | Oshima et al. | 400/605 |
| 5,033,890 | 7/1991 | Niikawa | 400/605 |
| 5,087,135 | 2/1992 | Tew et al. | 400/56 |

FOREIGN PATENT DOCUMENTS

| | | | |
|---|---|---|---|
| 3630782 | 3/1988 | Germany . | |
| 58-008678 | 4/1983 | Japan . | |
| 0219078 | 11/1985 | Japan | 400/605 |
| 60-257265 | 12/1985 | Japan . | |
| 02630079 | 11/1987 | Japan | 400/605 |
| 0035370 | 2/1988 | Japan | 400/605 |

*Primary Examiner*—Edgar S. Burr
*Assistant Examiner*—Christopher A. Bennett
*Attorney, Agent, or Firm*—Wolf, Greenfield & Sacks

[57] ABSTRACT

In a printing apparatus comprising a first conveyance system (C1) for conveying a first printing medium (3), a second conveyance system (C2) for conveying a second printing medium (6), and a print head (1) for conducting printing on the first or second printing medium on a platen (2), a detector (13) detects presence or absence of the first printing medium on the first conveyance system (C1), and a platen drive controller (18) causes rotation of the platen during the printing or conveyance of the second printing medium if the first printing medium is found present in the first conveyance system (C1). The platen drive controller may conduct the control over the rotation also on the basis of the state of conveyance of the second printing medium in order to ensure rotation of the platen from time to time while avoiding excessive rotation to reduce noises and power consumption.

40 Claims, 9 Drawing Sheets

PRINTING APPARATUS

BACKGROUND OF THE INVENTION

The present invention relates to printing apparatus used, being connected to a host computer, and for example a dot impact serial printer.

FIG. 10 is a sectional view showing this type of printing apparatus in the prior art. Referring to the figure, a print head 1 performs spacing movement in a direction perpendicular to the page. A platen 2 is opposite to the print head 1. A continuous sheet, e.g., continuous form with preprinted frames, 3 is fed or conveyed, being wound over the platen 2. A tractor 4 having pins engaging perforations provided along edges of the continuous sheet 3 rotates to pull the continuous sheet 3 in the direction indicated by arrow 11 for forward feeding or line-feed, or in the reverse direction for rearward feeding or line-feed. A pinch roller 5 presses the continuous sheet 3 against the platen 2, rotation of which also pulls the continuous sheet 3 in the direction of arrow 11 or in the reverse direction. A pinch roller 8 presses a cut sheet, such as a slip with a preprinted frames, 6 against a drive roller 7, which thereby pulls the cut sheet 6 in the direction indicated by arrow 12 for forward feeding or line-feed, or in the reverse direction for rearward feeding or line-feed. Similarly, a pinch roller 10 presses the cut sheet 6 against a drive roller 9, which thereby pulls a cut sheet 6 in the direction indicated by arrow 12 or in the reverse direction.

Thus, the printing apparatus shown in FIG. 10 is provided with a first conveyance system C1 which comprises a continuous sheet conveyance mechanism M1 comprising the platen 2, the tractor 4 and the pinch roller 5 for conveying the continuous sheet 3 along a first conveyance path, and a drive system, not shown, comprising a drive motor, etc. for driving the continuous sheet conveyance mechanism M1, and a second conveyance system C2 which comprises a cut sheet conveyance mechanism M2 comprising the drive rollers 7 and 9, and the pinch rollers 8 and 10 for conveying the cut sheet 6 along a second conveyance path, and a second drive system, not shown, comprising a drive motor, etc. for driving the cut sheet conveyance mechanism M2.

Next, the continuous sheet conveyance operation and cut sheet conveyance operation of the printing apparatus of the type described above is described. FIG. 11 shows the state in which a continuous sheet 3 is conveyed. The continuous sheet 3 is conveyed forward in the direction indicated by arrow 11 by the rotational driving of the platen 2 and the tractor 4. It is essential that the platen 2 is formed of a material which can withstand the impact of the print head 1 and which has a coefficient of friction suitable for conveying the printing sheet. Hard rubber or the like is generally used as the material for the platen 2. FIG. 12 shows the state in which a cut sheet 6 is conveyed. The cut sheet 6 is driven forward in the direction indicated by arrow 12 by the rotational driving of the drive rollers 7 and 9 and the pinch rollers 8 and 10. During the cut sheet conveyance, the continuous sheet conveyance mechanism M1 is not moving.

As described above, in a printing apparatus having a continuous sheet conveyance mechanism M1 and a cut sheet conveyance mechanism M2, which can be driven independently, the printing and conveyance of a cut sheet can be conducted in the state in which the continuous sheet 3 is mounted on the platen 2 and the tractor 4. The continuous sheet conveyance mechanism M1 including the platen 2 is not moving.

Since the printing apparatus of the type described is configured as described above, and the platen 2 is not moving when the cut sheet is printed and conveyed, the print head 1 strikes the same parts of the platen 2 repetitively. As a result, wear, and impression (indentation as a result of impact by the print head) are formed on the platen 2, which leads to degradation in the performance of the printing sheet conveyance, degradation in the printing quality, and consequent shortening of the life of the printing apparatus.

SUMMARY OF THE INVENTION

The invention has been made to eliminate the above problems, and its object is to provide a printing apparatus having a longer life.

Another object of the invention is to provide a printing apparatus with smaller power consumption, and lower noises.

A printing apparatus according to the invention comprises:

(a) a first conveyance system including a platen for conveying a first printing medium along a first conveyance path;

(b) a second conveyance system for conveyance a second printing medium along a second conveyance path different from the first conveyance path;

(c) a print head for conducting printing on the first or second printing medium on the platen;

(d) a detecting means for detecting the state of mounting of the first printing medium on the first conveyance system; and (e) a platen drive controller for controlling the rotation of the platen on the basis of the state of mounting of the first printing medium on the first conveyance system as detected by said detecting means, during the printing or conveyance of the second printing medium by the print head and the second conveyance system.

The platen drive controller causes occasional rotation of the platen even when the printing is made on the second printing medium. As a result, impacts on the same parts of the platen by the print head are reduced, so that the life of the platen is lengthened.

According to an additional feature of the invention, the state of conveyance of the second printing medium, such as the thickness of the second printing medium being conveyed by the second conveyance system, the number of lines by which the second printing medium is line-fed, the feed-in or discharge of the second printing medium, is detected, and used for restricting the conditions under which the rotation of the platen is effected. As a result, excessive rotation of the platen is avoided, and noises and power consumption are therefore reduced.

DETAILED DESCRIPTION OF THE PREFERRED EMBODIMENTS

Embodiment 1

Figure 1:
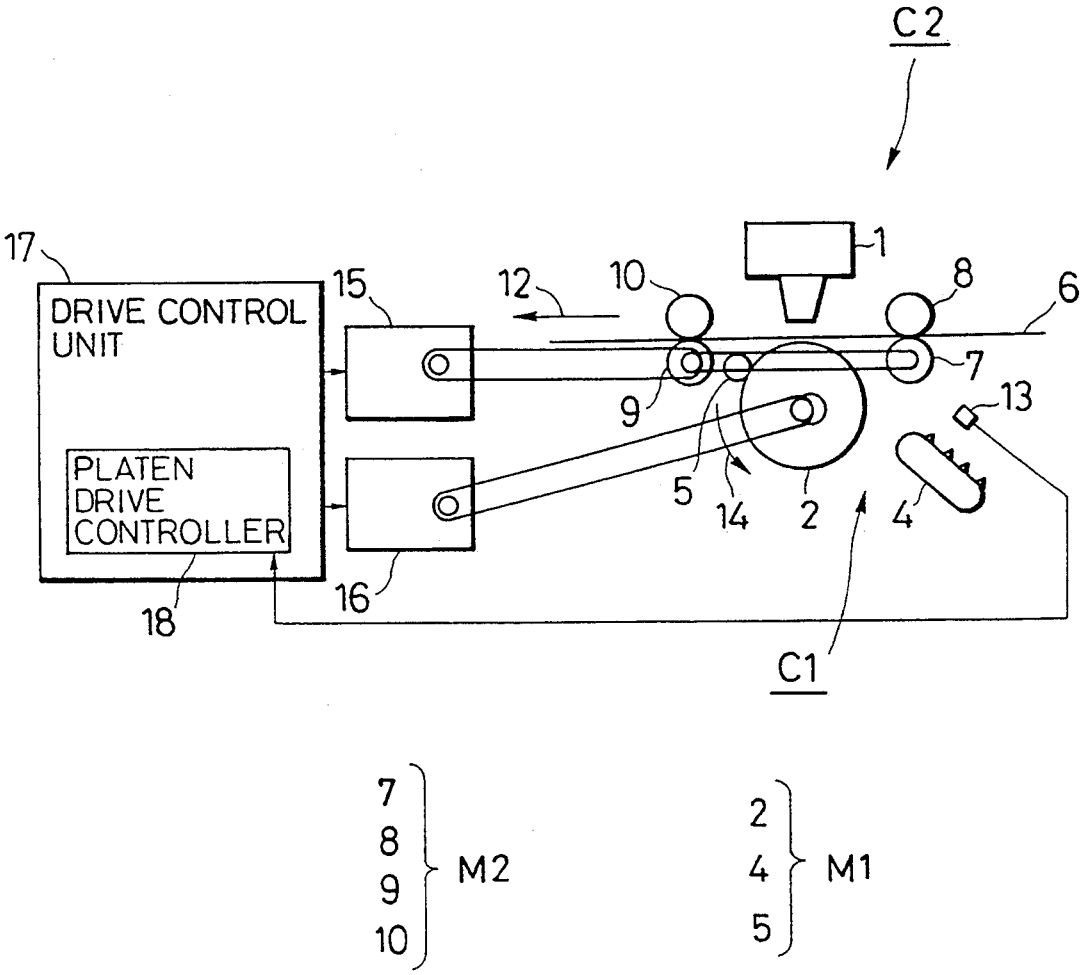
FIG. 1 is a sectional view showing a printing apparatus according to a first embodiment of the invention.

An embodiment of the invention is described below with reference to the drawings. FIG. 1 is a diagram showing a printing apparatus of this embodiment. In the figure, reference numerals 1 to 10 denote members similar to those described in connection with the prior-art example. A detector 13 detects whether or not a continuous sheet 3 is mounted, i.e., is present in the conveyance path along which the continuous sheet 3 is conveyed. A platen drive controller 18 causes rotation of the platen 2 in the direction of arrow 14 for forward feeding or line-feed, or in the reverse direction for rearward feeding or line-feed. A drive motor 15 drives the drive rollers 7 and 9. A drive motor 16 drives the platen. A drive control unit 17 controls the drive motors. The platen drive controller 18 is within the drive control unit 17.

The operation is next described with reference to the flowchart of FIG. 2. When an instruction to feed in a cut sheet for printing is given, e.g., from a host computer not shown (101), this is detected by a means provided in the platen drive controller 18, and a cut sheet 6 is fed-in and fed to a position for printing (where the head of the area of the cut sheet to be printed confronts the print head 1) by drive of the cut sheet conveyance mechanism M2 (102). Decision is then made on the basis of an output of the detector 13 as to whether or not a continuous sheet 3 is present (104).

If a continuous sheet 3 is not present, the continuous sheet conveyance mechanism M1 including the platen 2 is driven simultaneously when the cut sheet conveyance mechanism M2 during line feed of the cut sheet 6 (108) after printing of each line (106). That is, the platen drive controller 18 is responsive to a signal from other part of the drive control unit 17 indicating completion of the printing of each line of commanding a line feed of the cut sheet, and supplies the drive motor 16 with a signal commanding rotation of the platen 2. In this embodiment, the rotation of the platen 2 is for the same amount as the cut sheet conveyance mechanism M2. That is the platen 2 rotates for the amount corresponding to the number of lines by which the cut sheet conveyance mechanism M2 performs the line-feeding. The platen 2 therefore rotates in the forward direction indicated by arrow 14, together with the line-feed movement of the cut sheet conveyance mechanism M2. The steps 106 and 108 are repeated until printing of all the lines has been completed (110). Upon completion of the printing of all the lines, the cut sheet is discharged (112).

Figure 3:
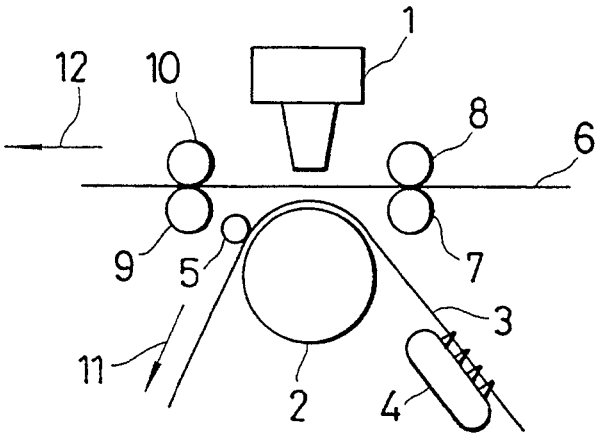
FIG. 3 is a sectional view showing the printing apparatus of the first embodiment in the state in which the continuous sheet is mounted.

If, at the step 104, a continuous sheet is present, as illustrated in FIG. 3, only the cut sheet conveyance mechanism M2 is driven (116) after the printing of each line (114). These steps 114 and 116 are repeated until the printing of all the lines is completed (118).

The drive control unit 17 including the platen drive controller 18 performing the above operation may be configured of a programmed computer.

Because the platen is also moved during line-feed, the points of impacts by the print head 1 are not concentrated at specific positions, but are distributed over the cylindrical surface of the platen 2, along the direction of rotation. Such simultaneous drive of the platen is inhibited when a continuous sheet is present, so that undesirable displacement of the continuous sheet is avoided.

In the illustrated embodiment, the drive of the platen 2 is achieved by actuation of the drive motor 16 which drives the continuous sheet conveyance mechanism M1 as a whole. If the platen 2 and the rest of the continuous sheet conveyance mechanism M1 can be driven separately, e.g., owing to provision of separate drive motors, it is sufficient to drive the platen 2, and the rest of the continuous sheet conveyance mechanism M1 may be kept at rest.

As has been described, the printing apparatus according to the above embodiment simultaneously drives the drive motor 16 for the platen 2 (as well as other parts of the continuous sheet conveyance mechanism M1) during line feed of the cut sheet 6.

Embodiment 2

A printing apparatus according to another embodiment of invention is described below.

Since the printing apparatus of the Embodiment 1 is configured as described above, the two drive motors for sheet conveyance are simultaneously driven, and as a result noises and power consumption are increased.

The Embodiment 2 is made to overcome these problems and aims at reducing noises and power consumption, and lengthening the life of the platen.

Figure 4:
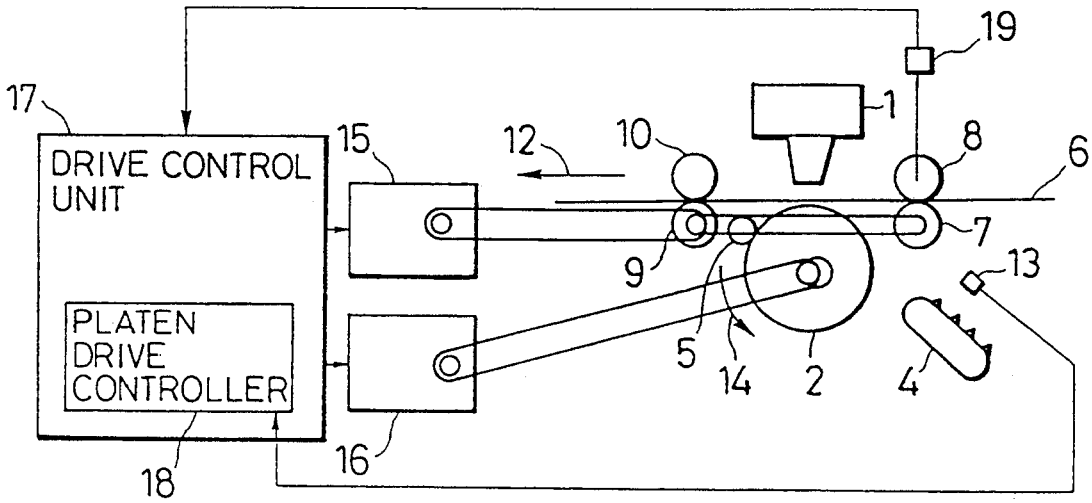
FIG. 4 is a sectional view showing a printing apparatus according to a second embodiment of the invention.

FIG. 4 is a section view showing the printing apparatus of this embodiment. The members identical or corresponding to those described with reference to the Embodiment 1 are denoted by identical reference numerals. A second detector 19 detects the thickness of the cut sheet in accordance with the position of the pinch roller 8. For distinction from the second detector 19, the detector 13 shown in the Embodiment 1 will hereinafter referred to as a first detector.

In short, the platen is driven when the thickness of the cut sheet 6 does not exceed a predetermined value. This scheme is adopted on the basis of the following discovery. That is, the strength of impact during printing differs depending on the thickness of the cut sheet, and when the cut sheet is more than a predetermined thickness, the impact on the platen is so weak that its effect on the life of the platen is negligible or is not considerable. Accordingly, if the thickness of the cut sheet as detected by the second detector 19 is more than a predetermined value, the simultaneous rotation of the platen is unnecessary.

The operation of the Embodiment 2 is next be described with reference to FIG. 5. The operation is similar to that described in connection with the Embodiment 1, but differs in that the simultaneous drive of the platen is inhibited when the thickness of the cut sheet exceeds a predetermined value.

Figure 2:
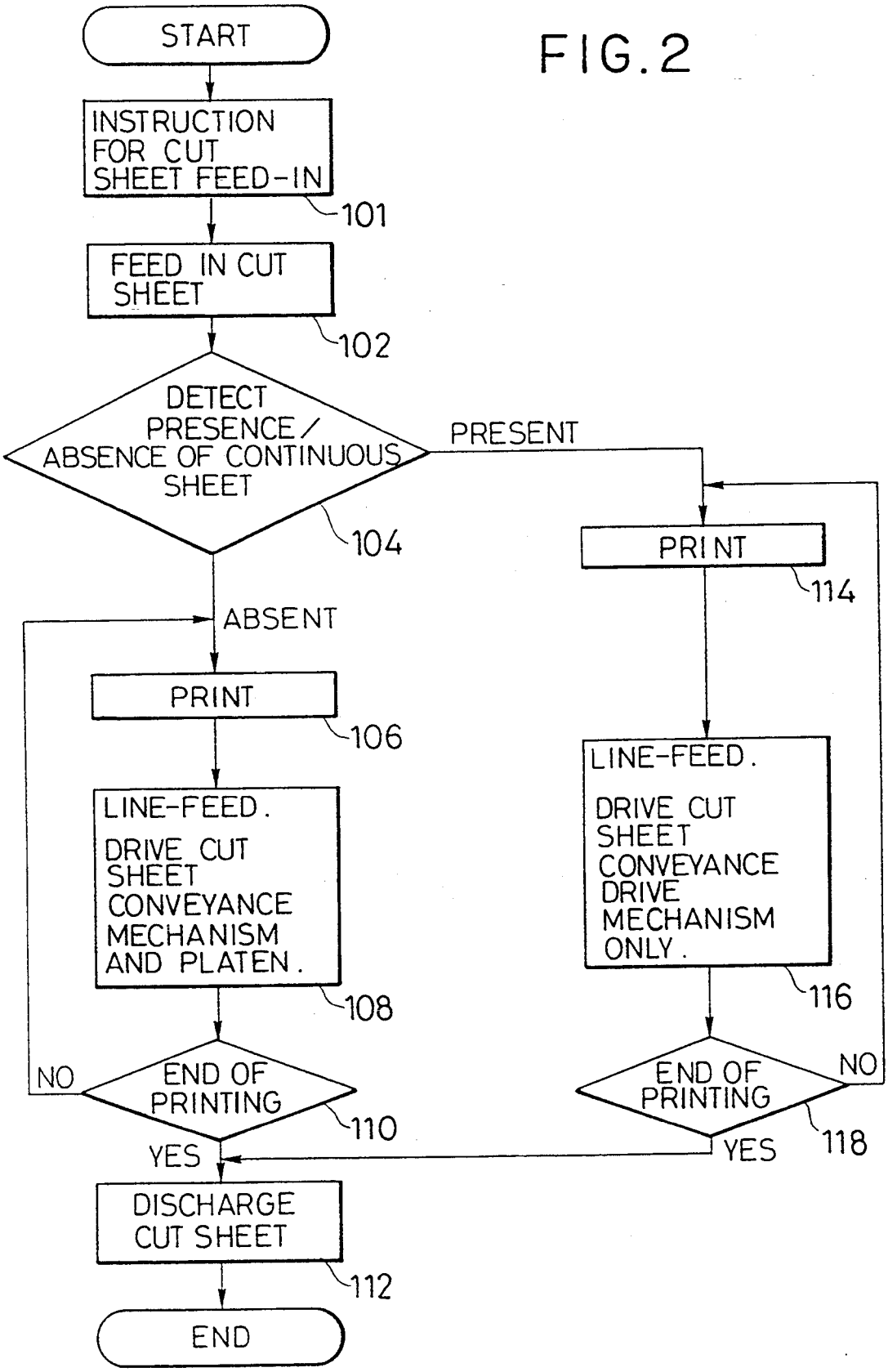
FIG. 2 is a flow chart showing the operation of the printing apparatus of the first embodiment of the invention.
Figure 5:
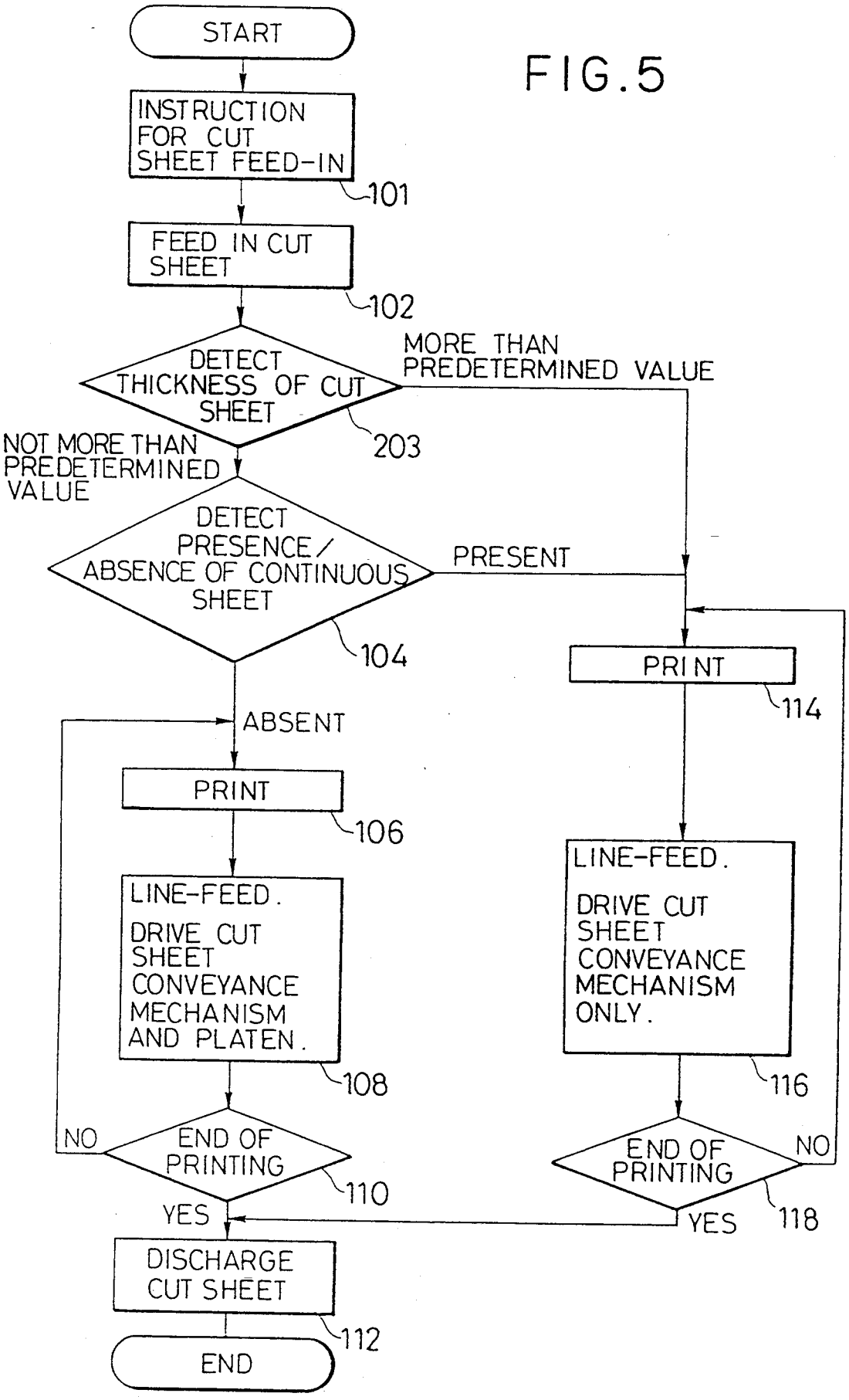
FIG. 5 is a flowchart showing the operation of the printing apparatus of the second embodiment.

In FIG. 5, the steps 101 to 118 are similar to those of the steps with identical reference numerals in FIG. 2. The only additional step 203 is inserted between the steps 102 and 104 for finding whether or not the thickness of the cut sheet is more than a predetermined value. If the thickness is more than the predetermined value, the process proceeds to the step 114 to inhibit the simultaneous drive of the platen 2. If the thickness of the cut sheet is not more than the predetermined value, the process proceeds to the step 104 for finding the presence or absence of the continuous sheet. The rest of the operation is identical to that described with reference to FIG. 2.

Since the rotation of the platen is inhibited when the thickness of the cut sheet exceeds a threshold value, unnecessary rotation of the platen is avoided, and noises and power consumption are reduced.

Figure 6:
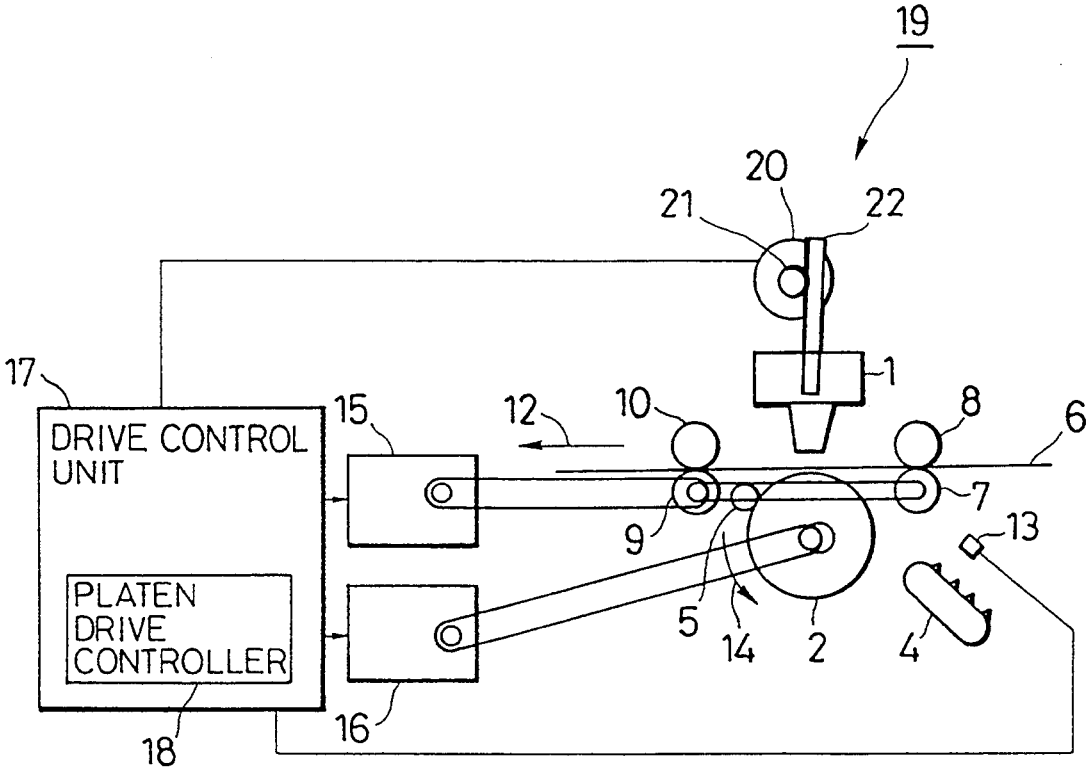
FIG. 6 is a sectional view showing a printing apparatus of a further embodiment of the invention with a different example of cut sheet thickness detector.

In the example of FIG. 4, the second detector 19 detects the thickness of the cut sheet on the basis of the position of the pinch roller. Instead, the second detector 19 for detecting the thickness of the cut sheet may be configured as shown in FIG. 6. As illustrated, it comprises a step motor 20, a pinion gear 21 and a rack 22.

By rotation of the step motor 20, the print head 1 is made to advance toward the platen 2 when no sheet is on the platen 2, until the print head 1 contacts the platen 2, with the contact being detected by the motor being stepped out due to the overload. After the contact, the step motor 20 is reversely rotated by a predetermined number of steps to retract the print head 1 to a position a predetermined distance from the surface of the platen 2. The print head 1 also made to advance toward the platen 2 when the cut sheet is on the platen 2, until the print head 1 contacts the cut sheet on the platen. After the contact, the motor 20 is reversely rotated by the same predetermined number of steps as above, to retract the print head 1 to a position the same predetermined distance from the surface of the cut sheet on the platen 2. The difference in the above-mentioned retracted position between the case when the cut sheet is not on the platen and the case when the cut sheet is on the platen gives the thickness of the cut sheet. The retracted position can be detected on the basis of the position or displacement of the rack 22, for example.

Embodiment 3

Figure 7:
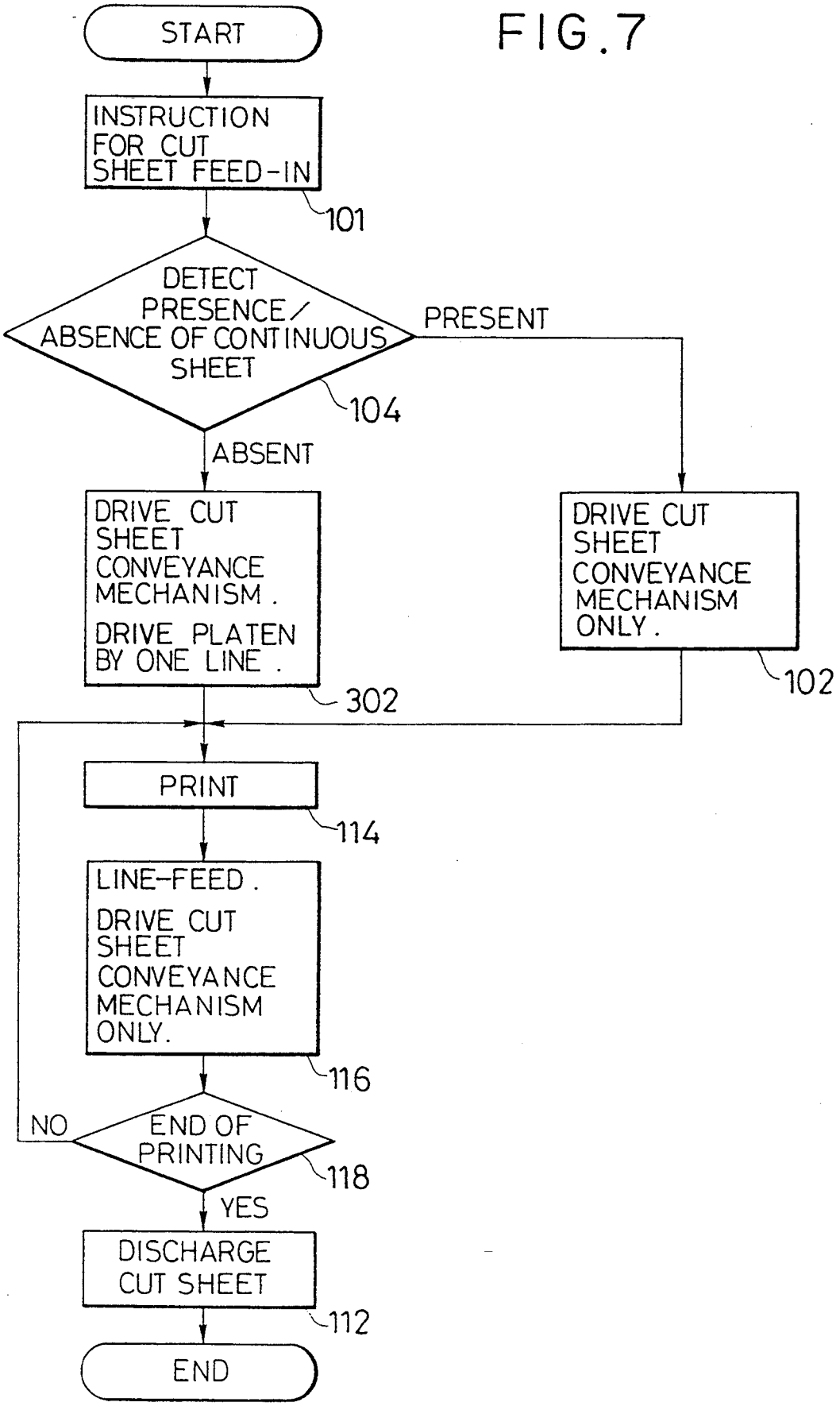
FIG. 7 and FIG. 8 are flowcharts showing the operations of the printing apparatus of further embodiments of the invention.

FIG. 7 shows the operation of another embodiment of the invention. Illustration of the configuration of this embodiment may be identical to that of FIG. 1. In short, this embodiment performs rotation of the platen 2 by one line each time a new cut sheet is fed in. This scheme is devised on the basis of the following concept.

The damage on the platen due to impact may not be serious through printing of a single cut sheet even if the printing is made at the same platen position. It may therefore be adequate if the platen is simultaneously rotated by one line-feed per each cut sheet, e.g., each time printing of one cut sheet is initiated or completed. For instance, the rotation of the platen 2 may be affected each time a new cut sheet is inserted or fed, or the printed cut sheet is discharged.

In the figure, the steps 101 to 118 are similar to those with identical reference numerals in FIG. 2. But the step 102 is performed only when a continuous sheet is found present at the step 104. When the continuous sheet is found absent, the platen 2 is driven by one line, together with the drive of the cut sheet conveyance mechanism M2 (302). After either of these steps (102 and 302), printing of one line (114) and subsequent line feed (116) are performed until the printing of all the lines is completed (118) and the cut sheet is then discharged (112).

Thus, in the embodiment of FIG. 7, either the step 102 or 302 is performed responsive to the instruction at step 101 (for feeding in the cut sheet), and after the step 104 (for finding whether a continuous sheet is present).

In the embodiment described above, the platen is rotated by one line per one cut sheet. In a modification, the platen may be rotated every a present number of cut sheets, e.g., after printing of preset number of consecutive cut sheets. What is essential is to effect rotation of the platen from time to time to avoid concentration of the impact at the same position.

By performing the rotation of the platen only once per one cut sheet or only once per a plurality of cut sheets, noises and power consumption are further reduced.

Embodiment 4

Figure 8:
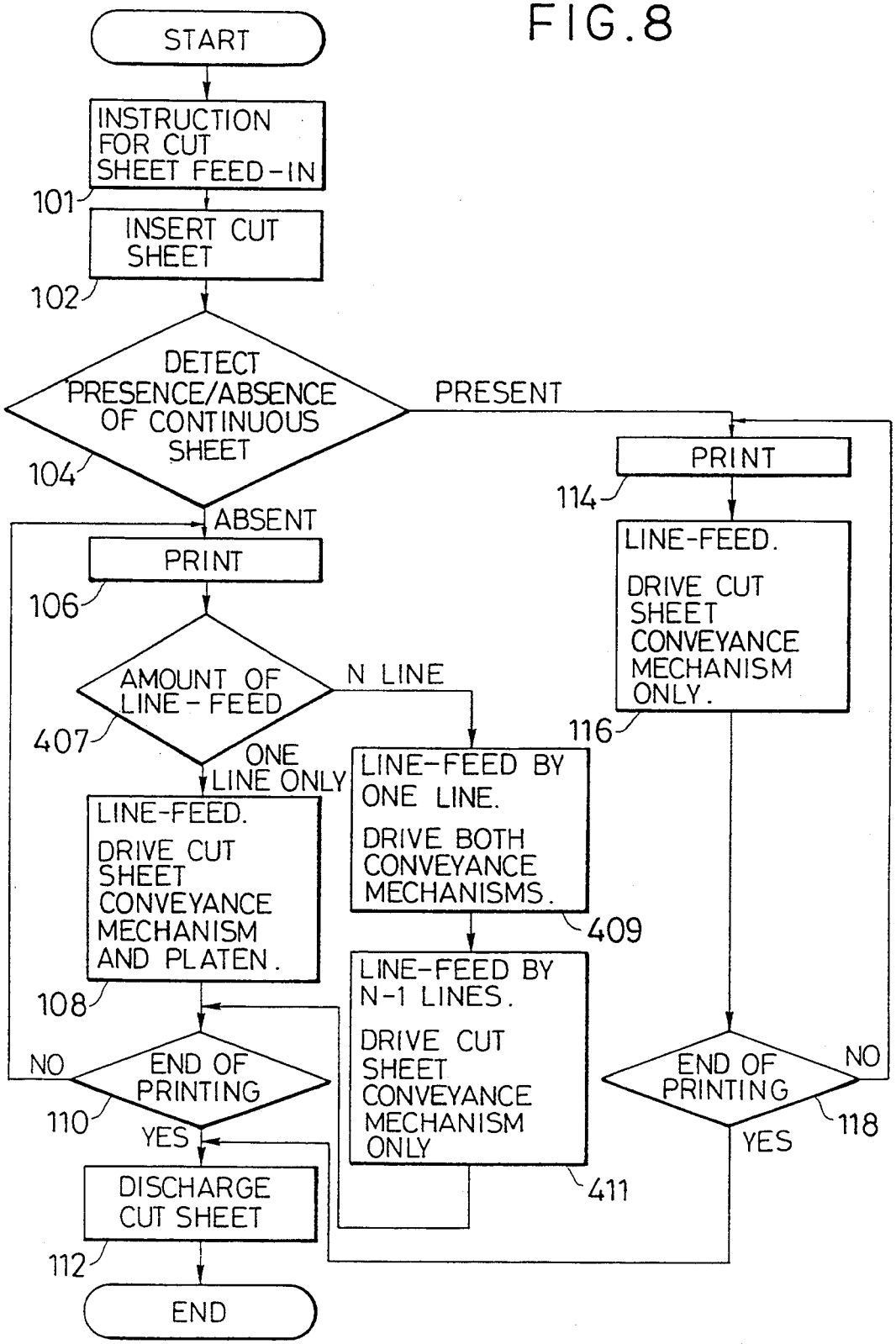

FIG. 8 shows a further embodiment of the invention. Illustration of the configuration of this embodiment may be identical to that of FIG. 1. In short, this embodiment performs rotation of the platen 2 by one line when the cut sheet is line-fed by a plurality of lines. More specifically, in the embodiment of FIG. 2, the platen is driven by the same amount (same number of lines) as the cut sheet conveyance mechanism M2. In the embodiment shown in FIG. 8, the platen is driven by one line (the amount moved for one line feed), each time the cut sheet is line-fed by one or more lines after printing of one line. This may happen where lines to be printed are separated by one or more non-printed lines.

In FIG. 8, steps 101 to 118 are similar to those with identical reference numerals in FIG. 2. A step 407 is inserted between the steps 106 and 108, and in this step 407 decision is made as to whether the line feed to be made is for one line or a plurality of lines, i.e., N lines (N being an integer greater than 1). If it is for one line, the process proceeds to the step 108. If it is for a plurality of lines, the platen and the cut sheet conveyance mechanism M2 are driven simultaneously by one line only (409), and then the cut sheet conveyance mechanism M2 is driven by (N-1) lines (411).

The decision as to whether the number of lines by which the cut sheet is line-fed is 1 or N made by a means formed of part of the platen driver controller 18 responsive to other part of the drive control unit 17 which produces a signal for the line feed of the cut sheet. As described before, the drive control unit 17 including the platen drive controller 18 may be configured of a programmed computer.

Because of the reduced number of lines by which the platen 2 is driven, the noises and power consumption are reduced.

Thus, in the printing apparatus according to FIG. 5 to FIG. 8, the state of conveyance of the cut sheet, such as the thickness of the cut sheet on the platen, the feed-in of the cut sheet, or the line-feed for a plurality of lines detected by the second detector, and on the basis of the state of conveyance of the cut sheet, the drive of the platen is controlled so as to ensure rotation of the platen from time to time and to avoid excessive rotation.

By restricting the conditions under which the simultaneous drive of the platen is effected, noises and power consumption can be reduced.

Figure 9:
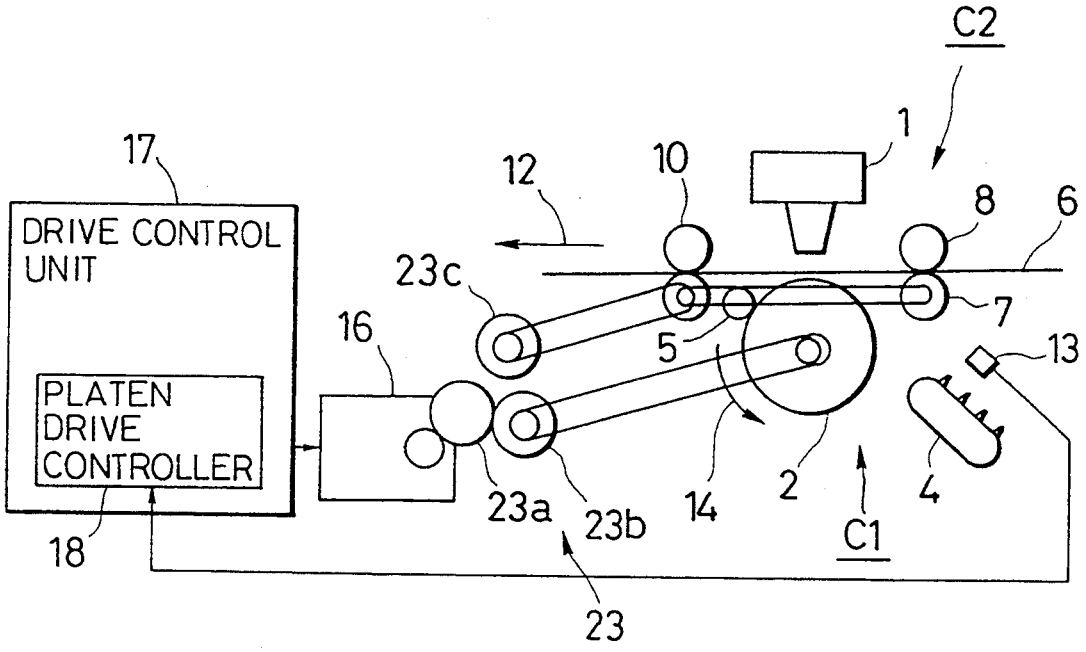
FIG. 9 is a sectional view showing a printing apparatus of a yet further embodiment of the invention with a transmission switching mechanism.
Figure 10:
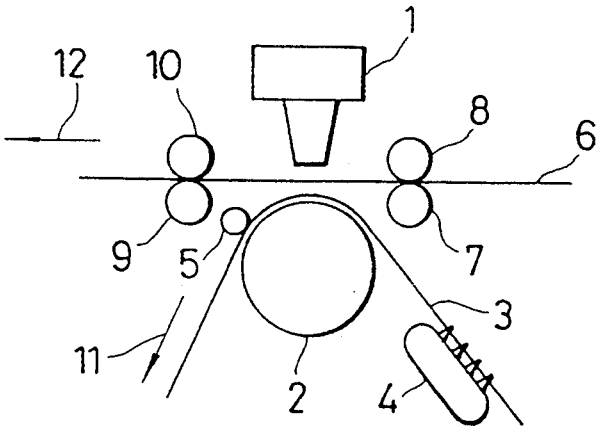
FIG. 10 PRIOR ART
FIG. 10 is a sectional view showing a prior-art printing apparatus.
Figure 11:
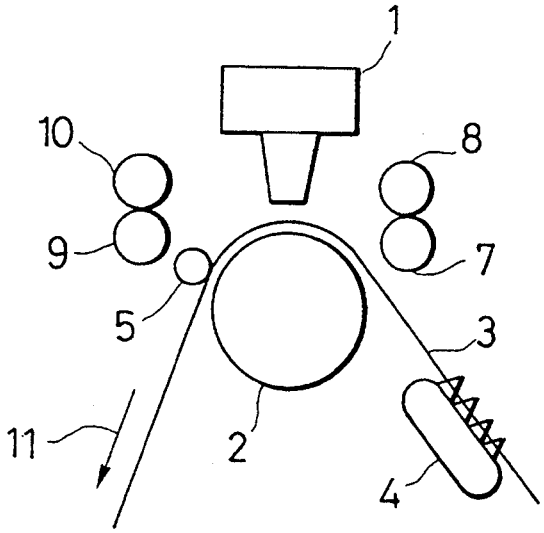
FIG. 11 PRIOR ART
FIG. 11 is a sectional view showing the prior-art printing apparatus in the state in which a continuous sheet is conveyed.
Figure 12:
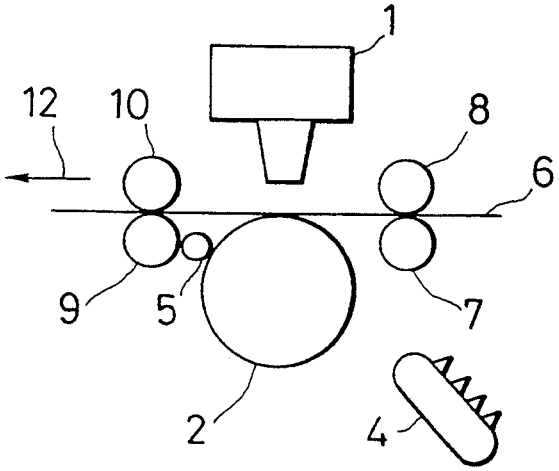
FIG. 12 PRIOR ART
FIG. 12 is a sectional view showing the prior-art printing apparatus in the state in which a cut sheet is conveyed.

In the above embodiments, the first and second conveyance systems C1 and C2 have respective drive motors. However, as shown in FIG. 9, a common drive motor 16 in combination with a transmission switching mechanism 23 may be provided to switch the transmission to rotate the first conveyance system C1 alone, or the second conveyance system C2 alone, or to effect simultaneous drive of the second conveyance system C2 and the platen 2. To rotate the first conveyance system C1, a friction roller or gear 23*b* of the first conveyance system C1 is engaged with a friction roller or gear 23*a* of the motor 16. To rotate the second conveyance system C2, a friction roller or gear 23*c* of the second conveyance system C2 is engaged with the friction roller or gear 23*a* of the motor 16. To rotate both the second conveyance system C2 and the platen 2, the friction roller or gear 23*b* and the friction roller or gear 23*c* are both engaged with the friction roller or gear 23*a* of the motor 16.

The line-feed described with reference to FIG. 4 to FIG. 8 may be for one line. It may alternatively be for lines greater than one, i.e., a preset number of lines.

In the embodiments described, the continuous sheet and the cut sheet with preprinted frames (which may be termed a preformed sheet) are taken as examples. The invention is not limited to these, but may be applied to cut sheet and continuous sheet without preprinted frames. The sheet may be other than paper but any other medium. The printing may be of characters, figure, images, marks, or any other data.

As has been described, according to the invention, the platen is rotated during printing or conveyance by the second conveyance system C2 in the state in which the continuous sheet is not mounted on the first conveyance system C1 including the platen, the life of the apparatus is longer than the prior-art printing apparatus.

When the rotation of the platen is performed only under predetermined conditions, relating to the state of conveyance of the second printing medium, such as the thickness of the second printing medium, the feed-in or discharge of the second printing medium, the line feed of the second printing medium for more than one lines, the noises and power consumption are reduced.

What is claimed is:

1. A printing apparatus comprising:

(a) a first conveyance system including a platen for conveying a first printing medium along a first conveyance path;

(b) a second conveyance system for conveying a second printing medium along a second conveyance path different from the first conveyance path; said second conveyance system conveys said second printing medium over said platen;

(c) a print head for conducting printing on the first or second printing medium on the platen;

(d) a platen drive controller for controlling the rotation of the platen at a rate that causes the surface of the platen below the second printing medium to move at a rate that is different from the rate of conveyance of the second medium on the conveyance system, and an additional detecting means which detects the thickness of the second printing medium and wherein said platen drive controller includes means for causing rotation of the platen only when the detected thickness is smaller than a predetermined value.

2. The apparatus according to claim 1, further including a second detecting means constructed to detect the feed in or discharge of the second printing medium and constructed to generate a signal indicating the feed in or discharge of the second printing medium, and wherein said platen drive controller causes rotation of the platen when the feed in or discharge is detected.

3. The apparatus according to claim 1 further including a detecting means for detecting whether the first printing medium is mounted on the first conveyance system, and wherein the platen drive controller includes means for selecting between enabling and disabling the rotation of the platen on the basis of whether the first printing medium is mounted on the first conveyance system as detected by said detecting means, during the printing or conveyance of the second printing medium by the print head and the second conveyance system.

4. The apparatus according to claim 1, wherein said platen drive controller includes means for causing rotation of the platen by one line when the second printing medium is line-fed by a plurality of lines.

5. The apparatus according to claim 1, wherein said platen drive controller includes means for causing rotation of the platen by one line at a time.

6. The apparatus according to claim 1, wherein said first printing medium is a continuous sheet of paper and said second printing medium is a cut sheet of paper.

7. A method of operating a printing apparatus, comprising:

conveying a first printing medium on a first conveyance system, printing with a print head on the printing medium over a platen, rotating the platen during said step of printing or said step of conveying at a rate that causes the surface of the platen below the first printing medium to move at a rate that is different from the rate of conveyance of said first medium on said conveyance system, and detecting that the thickness of the first printing medium is smaller than a predetermined value, and wherein the step of rotating takes place in response to the step of detecting.

8. The method of claim 7 wherein the step of rotating includes rotating the platen by a single line each time a sheet of the printing medium is conveyed in the step of conveying.

9. The method of claim 7 further including the step of detecting the feed or discharge of the first printing medium and wherein the step of rotating takes place in response to the step of detecting.

10. The method of claim 9 wherein the step of rotation takes place by one line in response to each step of detecting the feed or discharge.

11. The method of claim 10 wherein the step of conveying conveys a cut sheet of paper as the first print medium and wherein the step of detecting detects a continuous sheet of paper as the second print medium.

12. The method of claim 11 wherein the step of rotating takes place by one line at a time.

13. The method of claim 10 wherein the step of rotating takes place by one line when the first printing medium is line-fed by a plurality of lines.

14. The method of claim 13 wherein the step of conveying conveys a cut sheet of paper as the first print medium and wherein the step of detecting detects a continuous sheet of paper as the second print medium.

15. The method of claim 14 wherein the step of rotating takes place by one line at a time.

16. The method of claim 7 wherein the step of rotating takes place by one line when the first printing medium is line-fed by a plurality of lines.

17. The method of claim 7 wherein the step of rotating takes place by one line at a time.

18. The method of claim 7 wherein the step of conveying conveys a cut sheet of paper as the first print medium and further including the step of conveying a continuous sheet of paper over the platen as a second print medium.

19. A method of operating a printing apparatus, comprising:

conveying a first printing medium on a first conveyance system, printing with a print head on the printing medium over a platen, rotating the platen during said step of printing or said step of conveying at a rate that causes the surface of the platen below the first printing medium to move at a rate that is different from the rate of conveyance of said first medium on said conveyance system, and detecting the absence of a second printing medium on a second conveyance system and wherein the step of rotation is performed in response to the step of detecting.

20. The method of claim 19 wherein the step of conveying conveys a cut sheet of paper as the first print medium and wherein the step of detecting detects a continuous sheet of paper as the second print medium.

21. The method of claim 19 wherein the step of rotating includes rotating the platen by a single line each time a sheet of the printing medium is conveyed in the step of conveying.

22. The method of claim 19 further including the step of detecting that the thickness of the first printing medium is smaller than a predetermined value, and wherein the step of rotating takes place in response to the step of detecting.

23. The method of claim 22 wherein the step of conveying conveys a cut sheet of paper as the first print medium and wherein the step of detecting detects a continuous sheet of paper as the second print medium.

24. The method of claim 19 further including the step of detecting the feed or discharge of the first printing medium and wherein the step of rotating takes place in response to the step of detecting.

25. The method of claim 24 wherein the step of rotating takes place by one line in response to each step of detecting the feed or discharge.

26. The method of claim 25 wherein the step of conveying conveys a cut sheet of paper as the first print medium and wherein the step of detecting detects a continuous sheet of paper as the second print medium.

27. The method of claim 19 wherein the step of rotating takes place by one line when the first printing medium is line-fed by a plurality of lines.

28. The method of claim 27 wherein the step of conveying conveys a cut sheet of paper as the first print medium and wherein the step of detecting detects a continuous sheet of paper as the second print medium.

29. The method of claim 19 wherein the step of rotating takes place by one line at a time.

30. A printing apparatus, comprising:

means for conveying a first printing medium on a first conveyance system, a platen a print head for printing on the printing medium over the platen, means for rotating the platen during printing by said print head or conveying by said means for conveying at a rate that causes the surface of the platen below the first printing medium to move at a rate that is different from the rate of conveyance of said first medium on said conveyance system, and means for detecting the absence of a second printing medium on a second conveyance system and wherein the means for rotating is responsive to the means for detecting to rotate the platen in response to detection by the means for detecting of the absence of the second printing medium on the second conveyance system.

31. The printer of claim 30 wherein the means for conveying a first printing medium is for conveying a cut sheet of paper as the first print medium and wherein the means for detecting is for detecting a continuous sheet of paper as the second print medium.

32. The printer of claim 30 wherein the means for rotating is for rotating the platen by a single line each time a sheet of the printing medium is conveyed by the means for conveying.

33. The printer of claim 30 further including means for detecting that the thickness of the first printing medium is smaller than a predetermined value, and wherein the means for rotating is responsive to the means for detecting that the thickness of the fist printing medium is smaller than a predetermined value.

34. The printer of claim 33 wherein the means for conveying is for conveying a cut sheet of paper as the first print medium and wherein the means for detecting the absence of a second printing medium is for detecting a continuous sheet of paper as the second print medium.

35. The printer of claim 30 further including means for detecting the feed or discharge of the first printing medium and wherein the means for rotating is responsive to the means for detecting the feed or discharge.

36. The printer of claim 35 wherein the means for rotating is for rotating by one line in response to detection of the feed or discharge by the means for detecting the feed or discharge.

37. The printer of claim 36 wherein the means for conveying a first printing medium is for conveying a cut sheet of paper as the first print medium and wherein the means for detecting the absence of a second printing medium is for detecting a continuous sheet of paper as the second print medium.

38. The printer of claim 30 wherein the means for rotating is for rotating the platen by one line when the first printing medium is line-fed by a plurality of lines by the means for conveying a first printing medium.

39. The printer of claim 38 wherein the means for conveying a first printing medium is for conveying a cut sheet of paper as the first print medium and wherein the means for detecting is for detecting a continuous sheet of paper as the second print medium.

40. The printer of claim 30 wherein the means for rotating is for rotating the platen by one line at a time.

* * * * *

UNITED STATES PATENT AND TRADEMARK OFFICE

CERTIFICATE OF CORRECTION

PATENT NO. : 5,382,104

DATED : January 17, 1995

INVENTOR(S) : Tetsuro Hirono and Mikio Shinada

It is certified that error appears in the above-identified patent and that said Letters Patent is hereby corrected as shown below: On the title page:

ITEM: [22] please insert -- "Related U.S. Application Data" [63] Division of Serial No. 07/929,308, Filed August 12, 1992 -- .

At column 1 after the title insert -- This application is a division of application Serial No. 07/929,308 filed August 12, 1992. --

Signed and Sealed this

Sixteenth Day of May, 1995

*Attest:*

Bruce Lehman

BRUCE LEHMAN

*Attesting Officer*

*Commissioner of Patents and Trademarks*